US011173094B1

(12) United States Patent
McGarvey

(10) Patent No.: US 11,173,094 B1
(45) Date of Patent: Nov. 16, 2021

(54) SHOCK ABSORBER UNDER ARM ADJUSTABLE HEIGHT WALKING CRUTCH

(71) Applicant: Paul Anthony McGarvey, Oceanside, CA (US)

(72) Inventor: Paul Anthony McGarvey, Oceanside, CA (US)

( * ) Notice: Subject to any disclaimer, the term of this patent is extended or adjusted under 35 U.S.C. 154(b) by 0 days.

(21) Appl. No.: 16/350,534

(22) Filed: Nov. 29, 2018

Related U.S. Application Data

(60) Provisional application No. 62/708,393, filed on Dec. 8, 2017.

(51) Int. Cl.
*A61H 3/02* (2006.01)

(52) U.S. Cl.
CPC ..... *A61H 3/0277* (2013.01)

(58) Field of Classification Search
CPC ..... A61H 3/0277; A61H 2023/0283
USPC ..... 135/82
See application file for complete search history.

(56) References Cited

U.S. PATENT DOCUMENTS 1,334,208 A * 3/1920 Ames ..... A61H 3/0277 135/68
1,635,914 A * 7/1927 Weis ..... A61H 3/02 135/68
2,183,975 A * 12/1939 Savage ..... A45B 3/00 135/66
2,398,247 A * 4/1946 Redcliffe ..... A61H 3/02 135/69
2,429,409 A * 10/1947 Eidman ..... A61H 3/02 135/72
2,442,896 A * 6/1948 Joseph ..... A61H 3/02 135/73
2,547,265 A * 4/1951 Hilgeman ..... A61H 3/02 135/73
2,690,188 A * 9/1954 Goddard ..... A61H 3/02 135/72
2,888,022 A * 5/1959 Fanning ..... A61H 3/0277 135/82
3,417,765 A * 12/1968 Slater ..... A61H 3/02 135/69

(Continued)

FOREIGN PATENT DOCUMENTS

CA 2466989 A1 * 11/2004 ..... A61H 3/0277
FR 625044 A * 8/1927 ..... A61H 3/0277

(Continued)

*Primary Examiner* — Robert Canfield
(74) *Attorney, Agent, or Firm* — Kilpatrick Townsend & Stockton LLP

(57) ABSTRACT

The new Shock Absorber Under Arm Adjustable Height Walking Crutches are standard aluminum adjustable height walking crutches modified with 4 coil springs added under the arm rest, one spring in each crutch pipe below the arm rest. Two per crutch 4 per pair of crutches, the springs are accommodated by a Pipe Spring Adapter which holds the springs in place and also allows the springs to move freely. The crutches are used exactly the same as standard aluminum adjustable height crutches but with the addition of the springs and pipe spring adapters the crutches now have a shock absorber effect under the arm rest. The springs actuate each time the user applies weight to the arm rest therefore alleviating the pain caused to the under arms by standard crutches.

3 Claims, 5 Drawing Sheets

(56) References Cited

U.S. PATENT DOCUMENTS

| | | | | | |
|---|---|---|---|---|---|
| 4,061,347 | A * | 12/1977 | Stern | A63C 11/222 | 280/821 |
| 4,753,259 | A * | 6/1988 | Hansen | A61H 3/02 | 135/68 |
| 5,114,186 | A * | 5/1992 | Sugiyama | A63C 11/221 | 280/821 |
| 5,720,474 | A * | 2/1998 | Sugiyama | A61F 2/60 | 135/75 |
| 6,595,226 | B2 * | 7/2003 | Uemura | A45B 9/00 | 135/69 |
| 6,898,824 | B2 * | 5/2005 | Zaltron | A63C 11/221 | 135/66 |
| 7,600,523 | B1 * | 10/2009 | Hawkesworth | A61H 3/0277 | 135/65 |
| 2011/0271992 | A1 * | 11/2011 | Senatro | A45B 9/00 | 135/75 |

FOREIGN PATENT DOCUMENTS

| | | | | | |
|---|---|---|---|---|---|
| FR | 662504 | A | * | 8/1929 | A61H 3/0277 |
| GB | 191200424 | A | * | 4/1912 | A61H 3/02 |
| GB | 320562 | A | * | 10/1929 | A61H 3/0277 |

* cited by examiner

SHOCK ABSORBER UNDER ARM ADJUSTABLE HEIGHT WALKING CRUTCH

CROSS-REFERENCES TO RELATED APPLICATIONS

This application claims priority to U.S. Provisional Application Ser. No. 62/708,393, filed Dec. 8, 2017, entitled "SHOCK ABSORBER UNDER ARM ADJUSTABLE HEIGHT WALKING CRUTCH".

BACKGROUND OF THE INVENTION

BRIEF SUMMARY

Shock Absorber Under Arm Walking Crutches are a modification of standard aluminum, adjustable height walking crutches. Standard crutches are modified to have springs adjacent to the under arm rest. The springs actuate by the pressure of the crutch user putting weight on the under arm rest. Each time the crutch user moves the springs move allowing for a much more comfortable crutch using experience.

DETAILED DESCRIPTION

Figure 1:
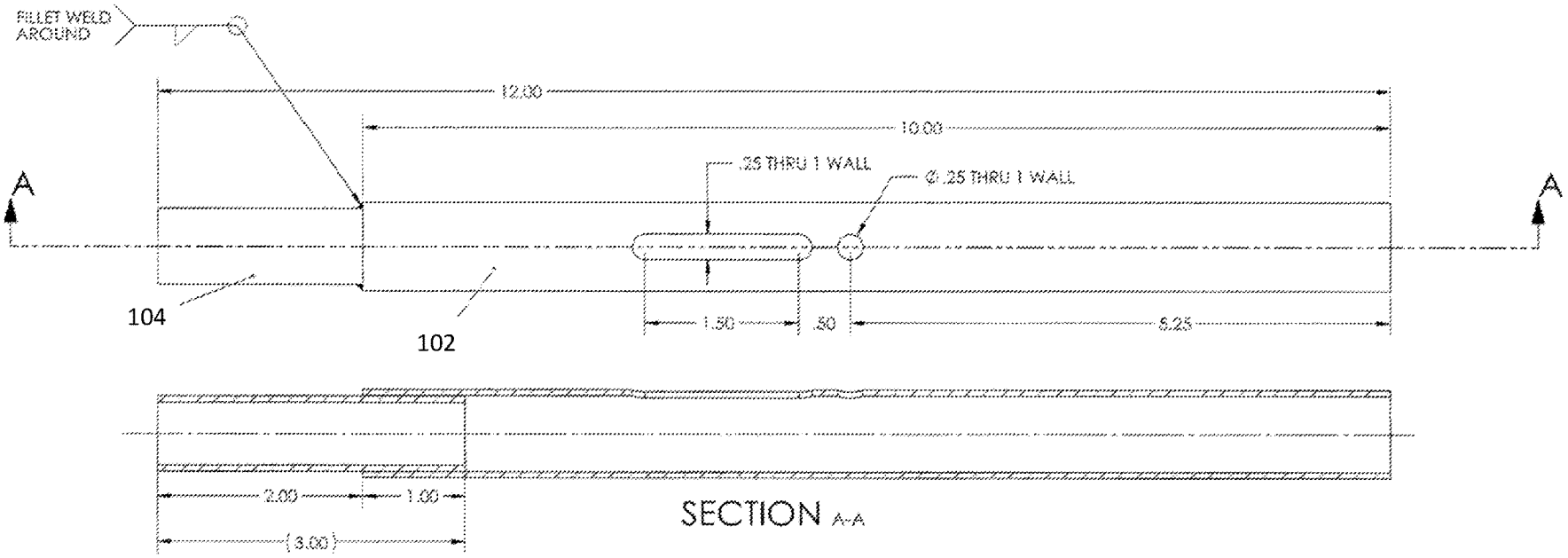
FIG. 1 depicts the Pipe Spring Adapter with fillet weld, ¼" hole and ¼" by 1&½" void.
Figure 2:
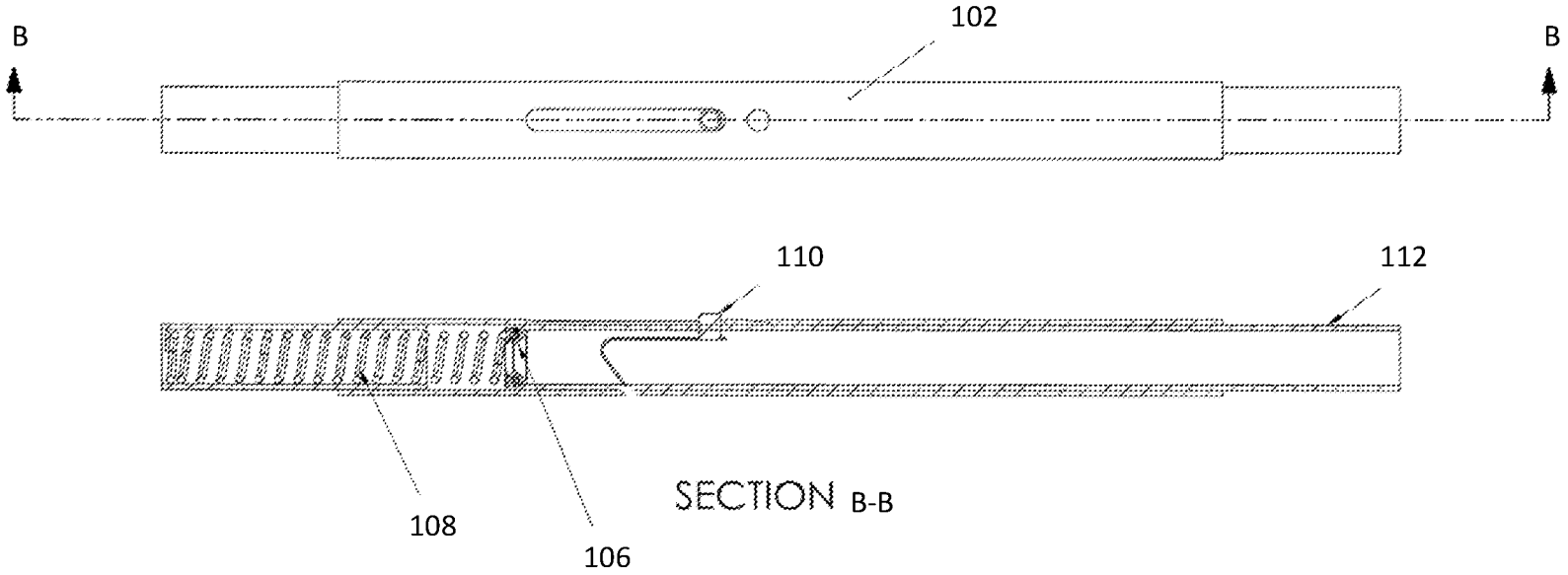
FIG. 2 depicts Pipe Spring Adapter with #12 finish washers, button clip, 4" by 0.610 O.D. coil spring and existing ¾" crutch piping.
Figure 3:
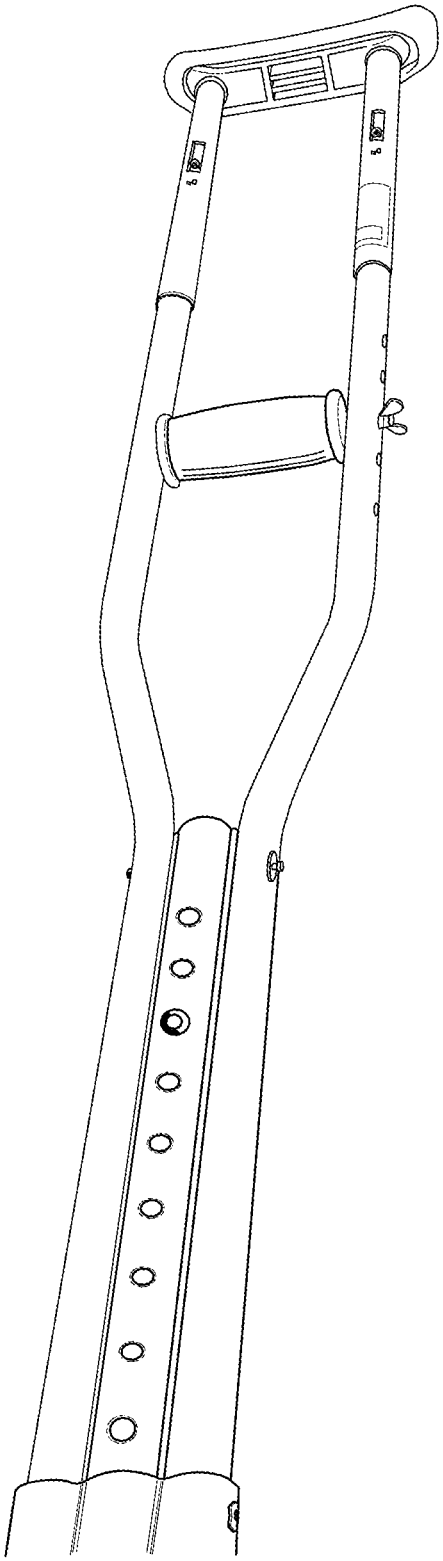
FIG. 3 shows assembled modified crutch, Shock Absorber Under Arm Adjustable Height Walking Crutch.
Figure 4:
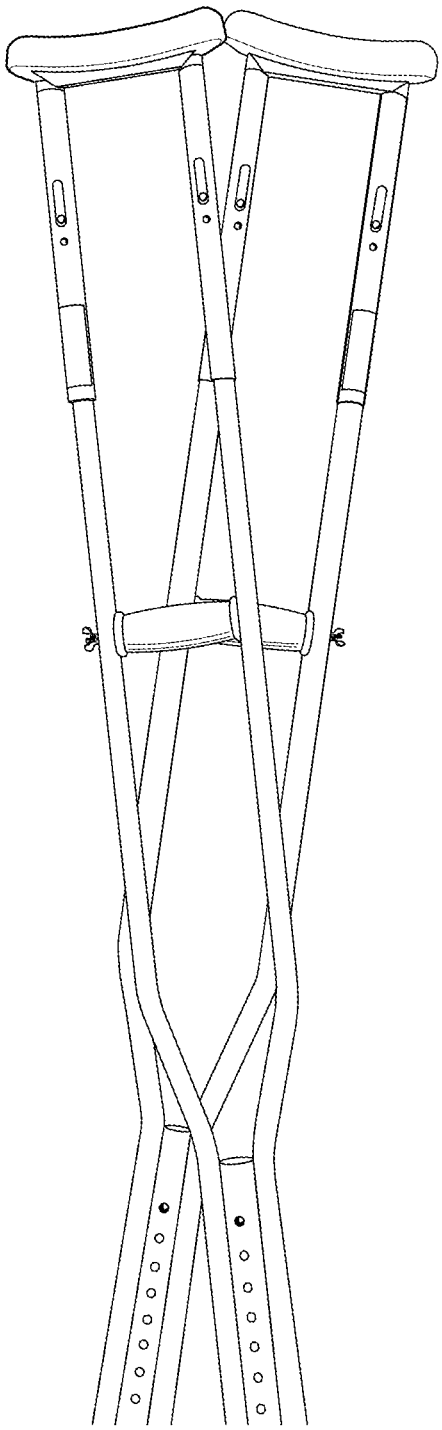
FIG. 4 shows assembled modified crutches also, Shock Absorber Under Arm Adjustable Height Walking Crutch.
Figure 5:
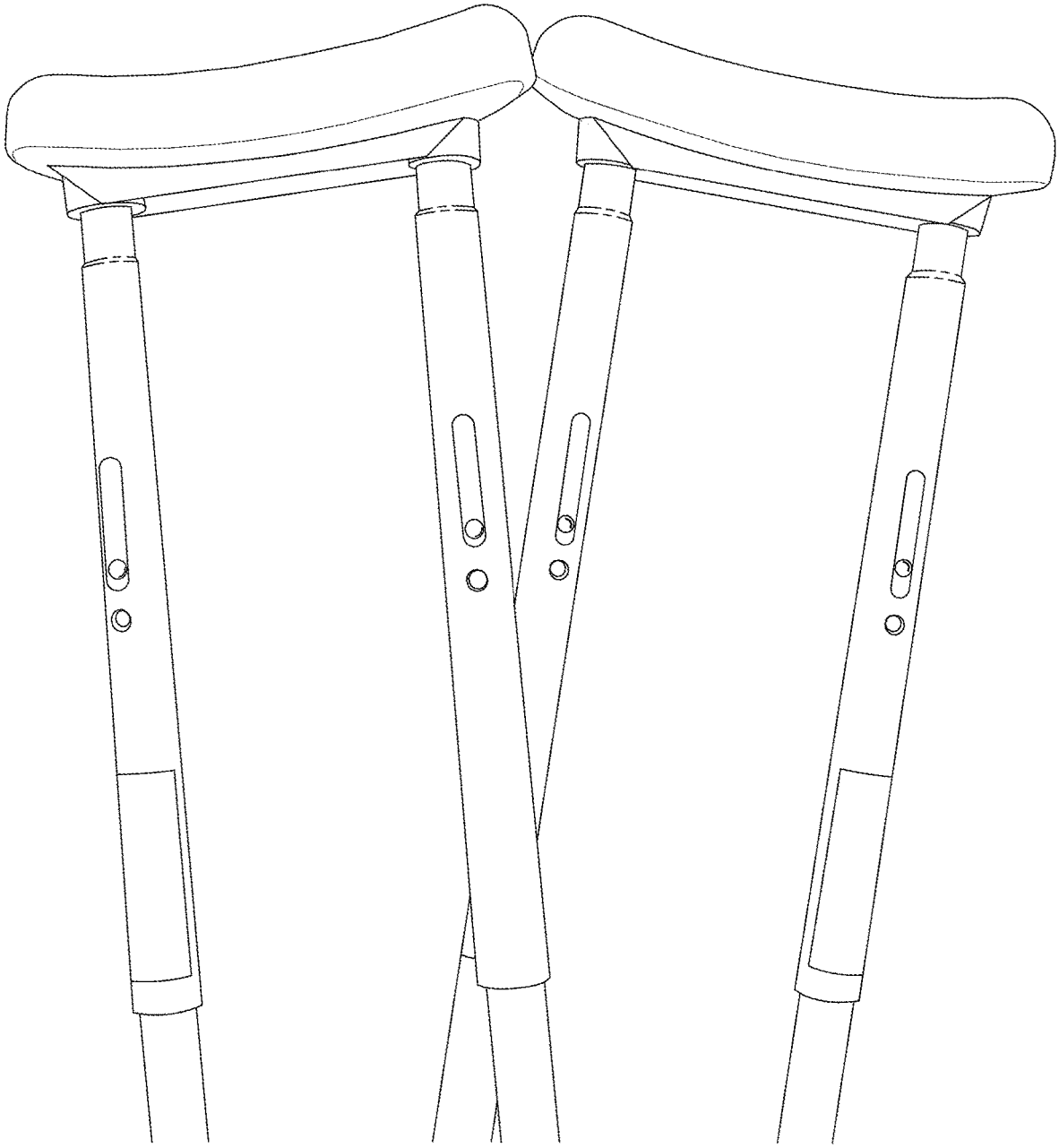
FIG. 5 shows a close up of assembled Pipe Spring Adapters for Shock Absorber Under Arm Adjustable Height Walking Crutch.

Shock Absorber Under Arm Walking Crutches are a modification of standard aluminum, adjustable height walking crutches. Standard crutches are modified to have springs 108 adjacent to the under arm rest. The springs actuate by the pressure of the crutch user putting weight on the under arm rest. Each time the crutch user moves, the springs 108 move allowing for a much more comfortable crutch using experience. Each of the two pipes adjacent to the arm rest are fitted with springs 108 and spring pipe adapters 102 to allow for a shock absorber effect when using the crutches.

The springs 108 can vary in strengths to allow for lighter and heavier crutch users. In one set of crutches there are a total of four springs 108 and four spring pipe adapters 102. The springs 108 have an O.D. measurement of approximately 0.61" to allow the springs 108 to fit inside ¾" aluminum tubing 112 that the crutches are made from. Springs 108 are coil springs 4" in length.

The "Pipe Spring Adapters" 102 are ⅞" O.D and 0.759" I.D. with a wall of 0.058" to allow the Pipe Spring Adapters to fit over the existing ¾"O.D. aluminum piping 112 without rubbing.

The Pipe Spring Adapters 102 are made of a 3" piece of ¾" 6061 aluminum with a 0.750" O.D. and a 0.625" I.D. and a 0.0625" wall, welded to a 10" piece of ⅞"6063 aluminum with a 0.875" O.D. and a 0.759" I.D. and a 0.058" wall.

The 3" by ¾" piece is welded to the 10" by ⅞" piece with 2" exposed and 1" concealed in the ⅞" pipe making the Pipe Spring Adapter 102 12" overall length. The top of the Pipe Spring Adapter 102, the ¾" pipe, fits into the base of the existing crutch 112 under arm rest, in place of the original ¾" crutch tubing 112. Approximately four inches of the top of the original ¾" crutch tubing 112 is removed and replaced by the "Pipe Spring Adapter" 102 and 4" coil spring 108.

The top of the Pipe Spring Adapter 102 sets 1&¼" inside the existing crutch 112 under arm rest, the maximum depth of the under arm rest seating and is secured by a self tapping lath head screw. The base of the Pipe Spring Adapter 102 is fitted over the existing crutch assembly, giving the ⅞" section of the Pipe Spring Adapter 102 an 8" overlap on the existing ¾" pipe tubing.

At the top of the remaining (4" was removed) existing %" crutch pipe (2) #12 finish washers 106 are stacked up side down to seat the new 4" coil spring. The springs 108 extend inside of the new Pipe Spring Adapter 102 through the ¾" pipe section of the adapter 102 all the way to the top of the base of the crutch under arm rest. The fact that 4" was removed from the existing crutch 112 and the 3" length of the ¾" pipe on the new Pipe Spring Adapter 102 allows for a 1" void in the %" pipe assembly. The 1" void creates an area for the spring to actuate giving the spring 108 1" of deflection before the two ¾" pipes touch each other. This is done on all four legs of a set of 2 crutches to allow for the coil springs 108 to act as a Shock Absorber making the crutch using experience much more comfortable for the crutch user. The 4 springs 108 deflect each time the user exerts weight on the arm rest.

The ⅞" section of the Pipe Spring Adapter 102 which is fitted over the remaining ¾" pipe on the exiting crutch has a ¾" hole drilled at 5&¼" center from the bottom of the ⅞" pipe of the pipe spring adapter 102 and a void or plow out ¾" wide and 1&½" long located at 5&¾" to 7&¼" from the bottom of the ⅞" pipe on the Pipe Spring Adapter. The hole and void are used in correlation with a 0.25" button clip 110 which is drilled for and set at 2&⅛" center from the top of the remaining existing %" crutch piping 112. The button clip 110 is placed in the void on the ⅞" pipe allowing the ⅞" pipe to move freely over the existing ¾" pipe 112 but also securing the ⅞" pipe from being removed or sliding off the ¾" pipe 102. The ¾" hole can be used to set the button clip 110 in, stopping the springs 108 from working and allowing the crutch to work as a standard aluminum adjustable height crutch. The ¼" hole also makes the Pipe Spring Adapters more difficult to disassemble. The fact that the button clip 110 is set at 2&⅛" from the top of the remaining existing ¾" crutch piping 112 ensures for no exposure of the 2 #12 finish washers 106 or springs 108.

The invention claimed is:

1. An underarm crutch to aid walking, the underarm crutch comprising:

a substantially horizontal underarm rest base having opposite ends, the underarm rest base configured to receive a pad;

a spaced-apart pair of upper tubing extending downward in parallel from the opposite ends of the underarm rest, each of the pair of upper tubing having a diameter of ⅞ inches and a length of 12 inches, each of the pair of upper tubing further having an elongated void of a length of 1.5 inches drilled in the tubing at 2 to 6 inches below the underarm rest base and a circular hole drilled in the tubing below the elongated void;

a spaced-apart pair of middle tubing, each of the pair of middle tubing having a diameter of ¾ inches and fitted respectively within one of the pair of upper tubing to a spaced distance from the underarm rest base, each of the pair of middle tubing further having a lower portion that angles inward toward the other of the pair of middle tubing, each of the pair of middle tubing further having:

a seat positioned at a top end of each of the pair of middle tubing;

a coil spring within an upper portion of each of the corresponding upper tubing, the coil spring having a proximal end positioned on the seat and a distal end connected with the underarm rest; and a deflectable button clip that is selectively positioned within the elongated void of the corresponding upper tubing to define and limit a compression of the coil spring, or within the circular hole of the corresponding upper tubing to inhibit compression of the coil spring;

a handgrip connected horizontally between the pair of middle tubing above the lower portion; and a lower tubing connected between the lower portion of the pair of middle tubing, the lower tubing extending downward below the pair of middle tubing to a distal end.

2. The underarm crutch in accordance with claim 1, wherein the upper tubing, middle tubing, and lower tubing are formed of aluminum.

3. The underarm crutch in accordance with claim 1, wherein the coil spring has a length of 4 inches.

* * * * *